US006083441A

United States Patent [19]

Ptaschek et al.

[11] Patent Number: 6,083,441

[45] Date of Patent: Jul. 4, 2000

[54] METHOD FOR MAKING A STACKABLE AND INEXPENSIVELY TRANSPORTABLE SPLASH BAR STRUCTURE

[75] Inventors: Lawrence Ptaschek; Everitt Stump, Jr., both of Roanoke; Charles Boxler, Troutville, all of Va.

[73] Assignee: NSW Corporation, Roanoke, Va.

[21] Appl. No.: 09/152,975

[22] Filed: Sep. 14, 1998

Related U.S. Application Data

[60] Provisional application No. 60/058,897, Sep. 15, 1998.

[51] Int. Cl.[7] ..... B29C 47/08

[52] U.S. Cl. ..... 264/159; 264/150; 261/111

[58] Field of Search ..... 261/111, 112.1, 261/110, 98, 97, DIG. 11; 425/308; 264/157, 159, 160, 148, 150; 156/244.18, 250

[56] References Cited

U.S. PATENT DOCUMENTS 5,112,537 5/1992 Kinney, Jr. ..... 261/111

5,185,105 2/1993 Peterson ..... 261/111

FOREIGN PATENT DOCUMENTS 59-124827 7/1984 Japan ..... 425/308

OTHER PUBLICATIONS

"Thermabar" A New Standard of Excellence in Crossflow Tower Cooling Efficiency, Thermatec, Santa Rosa, CA, pp. 1–5, 1985.

*Primary Examiner*—David A. Simmons
*Assistant Examiner*—Robert A. Hopkins
*Attorney, Agent, or Firm*—Mark H. Jay

[57] ABSTRACT

An elongated tubular structure of plastic strands is bisected along its axis to form open-topped self-supporting half-shells that can be used in cooling towers. The half-shells are stackable and can be transported in densely packed bundles.

4 Claims, 2 Drawing Sheets

METHOD FOR MAKING A STACKABLE AND INEXPENSIVELY TRANSPORTABLE SPLASH BAR STRUCTURE

CROSS-REFERENCE TO RELATED APPLICATIONS

This non-provisional application claims the benefit of provisional patent application Ser. No. 60/058,897, filed Sep. 15, 1998. The entire disclosure of this provisional patent application, including the disclosure of U.S. Pat. No. 5,185,105 to Peterson (which was attached thereto and incorporated therein) is hereby incorporated herein, as if fully set forth.

BACKGROUND OF THE INVENTION

The invention relates to splash bars such as are disclosed in U.S. Pat. No. 5,185,105, and more particularly relates to splash bars that are inexpensive to manufacture and to transport.

As is stated in U.S. Pat. No. 5,185,105 and in the above-referenced provisional patent application, splash bars are used in cooling towers. In a cooling tower, water to be cooled is broken up into smaller droplets and commingled with cooling air. This process of breaking up the water increases the surface area over which the water makes contact with the air, and therefore facilitates heat transfer between the water and the air. To accomplish this breakup, the water is directed onto fixed barriers, called splash bars, which cause the water to splash about within the cooling tower.

U.S. Pat. No. 5,185,105 discloses a particular type of splash bar. This splash bar is a tubular structure made up of strand material. The strand material has openings (called interstices) through which water may pass. This creates a great splash effect and prevents a water film (i.e. a sheet of water that is not divided into small droplets and that therefore exposes less surface area to the cooling air) from forming on the splash bars.

Although existing tubular splash bars are effective and commercially acceptable, they are expensive to ship. This is because tubular splash bars take up a relatively large volume. A stacked-up bundle of tubular splash bars must include one tubular void for each splash bar in the stack, which means that the splash bars cannot be densely packed during shipment.

It would be advantageous to provide a splash bar that was less expensive to ship and that could be densely packed during shipment.

Accordingly, one object of the invention is to provide a splash bar that can be less expensively shipped and more densely packed during shipment.

Another object is, in general, to improve on known splash bars of this general type.

In accordance with the invention, a tubular splash bar is manufactured using conventional techniques (extrusion being a suitable one). The thus-manufactured splash bar is a tubular, self-supporting structure formed of plastic strands. Large openings are located between the strands. In use, the structure is highly open to water passing through the openings. Then, in accordance with the invention, the tubular structure is bisected along its axis, as by cutting. This forms two self-supporting half-shells.

The half-shells have open tops, so that one can be stacked above the one below it. As a result, the tubular voids that exist when stacking tubular splash bars are eliminated, and the splash bars can be stacked densely so they take up less space during shipment.

BRIEF DESCRIPTION OF DRAWINGS

The invention will be better understood with reference to the following exemplary and non-limiting drawings, in which.

DETAILED DESCRIPTION OF PREFERRED EMBODIMENTS

Figure 1:
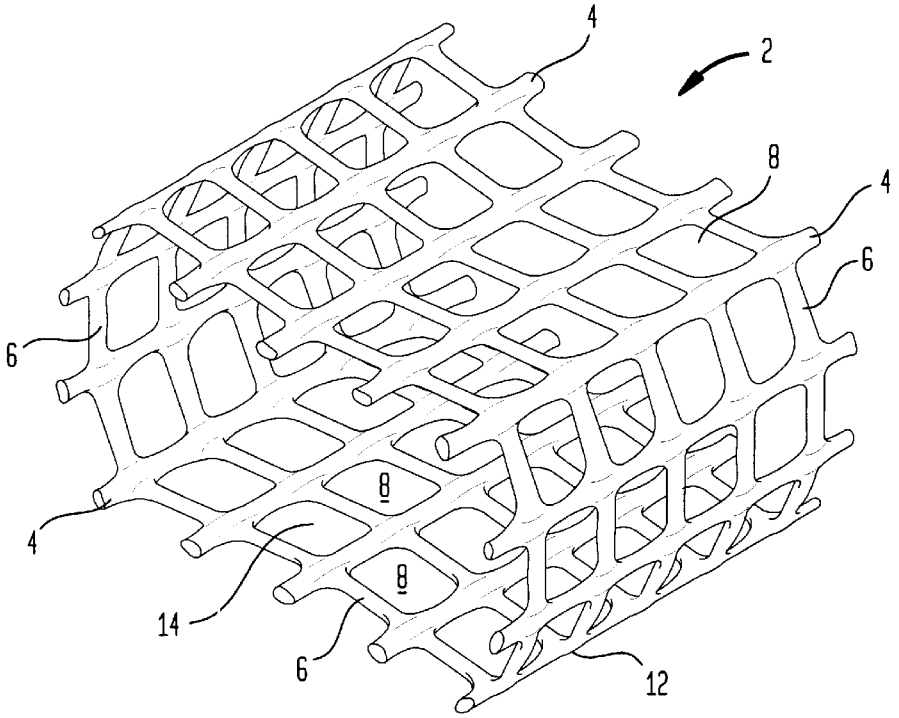
FIG. 1 illustrates a prior art splash bar.

In the known splash bar illustrated in FIG. 1, a tubular structure 2 is formed by extruding plastic strands. The structure 2 has longitudinally extending strands 4 and circumferentially extending strands 6, and forms a hollow open-ended tube that is generally rectangular in cross-section. Openings 8 are located between the strands 4 and 6. In use in a cooling tower (not shown), water (not shown) passes through the openings 8 and splashes against the strands 4 and 6, thereby being broken up into smaller droplets (not shown) to maximize heat transfer through the latent heat of vaporization between the water and the air (not shown) in the cooling tower.

Figure 2:
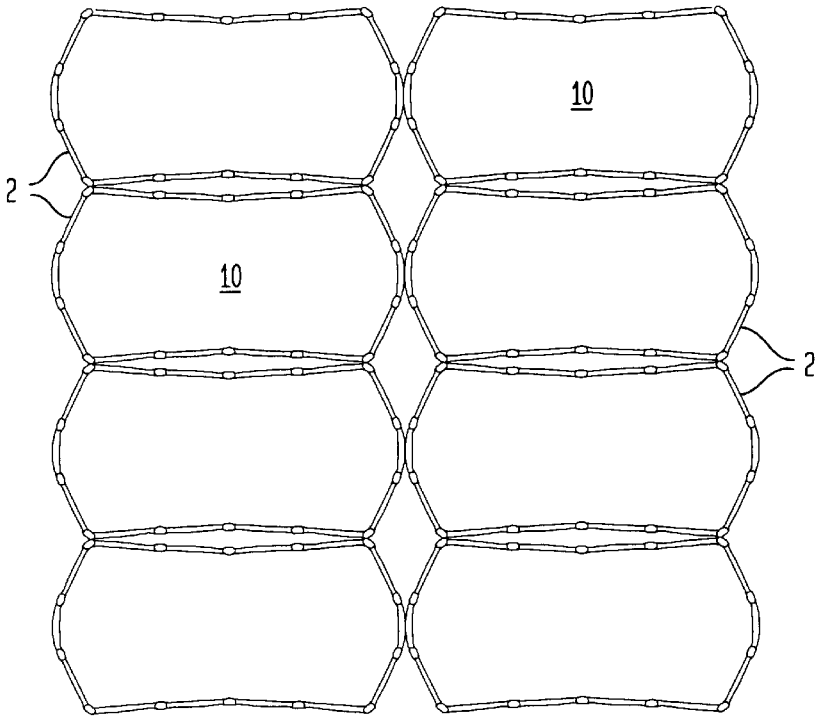
FIG. 2 illustrates how the FIG. 1 splash bar is stacked up for shipping.

As can be seen in FIG. 2, when FIG. 1 splash bars are stacked up into bundles for shipping, they take up a comparatively large volume. This is because each splash bar 2 contains a tubular void 10. As a result, a bundle of splash bars 2 will contain a large volume of empty space. This makes such a bundle expensive to ship.

Figure 3:
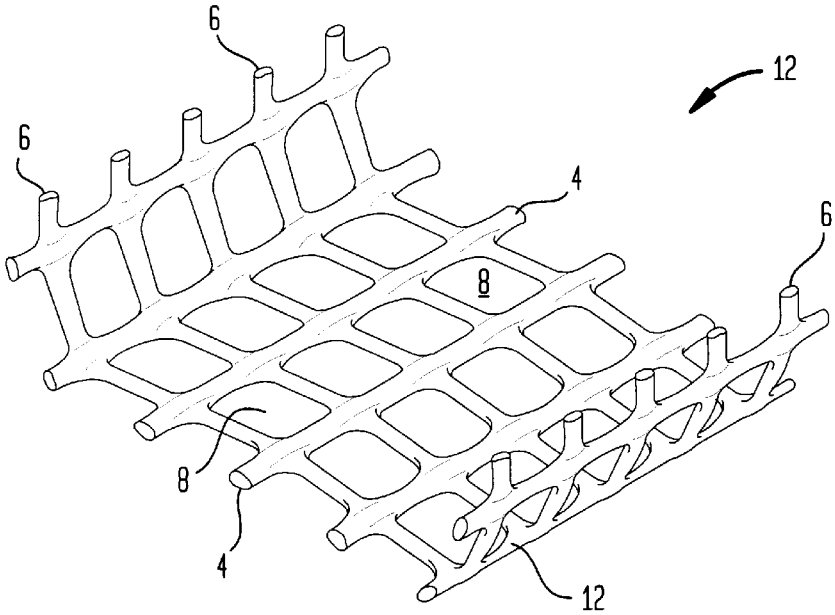
FIG. 3 illustrates a splash bar in accordance with the invention.

In accordance with the invention, the FIG. 1 structure is bisected parallel to its axis to form two open-topped half-shells 12 such as are illustrated in FIG. 3. (Advantageously but not necessarily, this is done by cutting the circumferential strands 6.) The strands 4 and 6 can be (but need not be) made somewhat thicker, to insure that the half-shells 12 will be self-supporting when used in a cooling tower (not shown).

Figure 4:
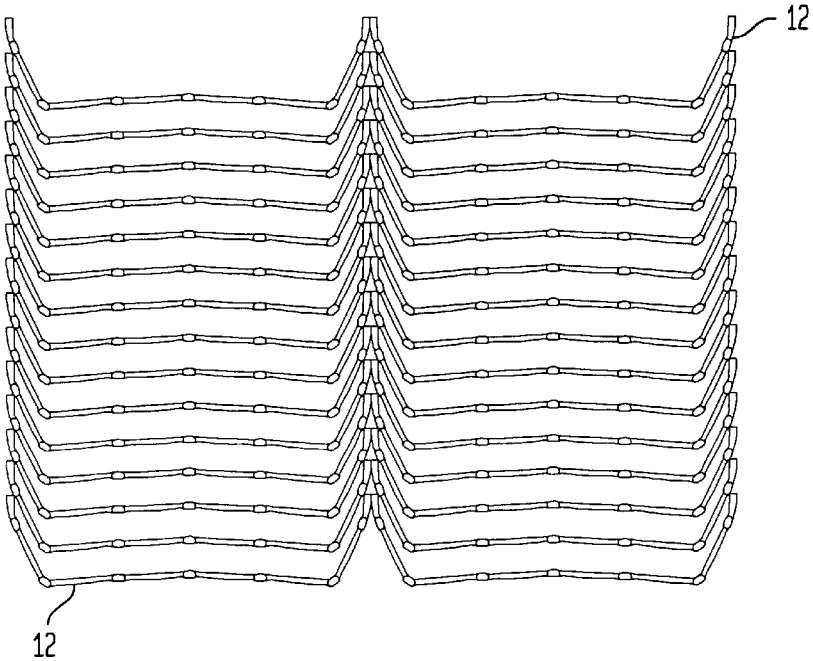
FIG. 4 illustrates how a splash bar in accordance with the invention is stacked up for shipping.

As can be seen in FIG. 4, the half-shells 12 are stackable, one on top of the other. They can therefore be bundled far more densely, making it possible to ship many more of them in the same volume and decreasing shipping cost.

Although the half-shells 12 are advantageously made up of longitudinally and circumferentially extending strands 4 and 6, this is not required. Another pattern of strands can be used instead. Likewise, although the structures 2 are advantageously rectangular in cross-section (for convenience in manufacturing), this is also not required; the half-shells 12 can alternatively be arcuate (e.g. semi-circular).

Although one or more preferred embodiments have been described above, the scope of the invention is limited only by the following claims:

What is claimed is:

1. A method of making a stackable and inexpensively transportable splash bar structure, comprising the following steps:

producing an axially elongated tubular structure from plastic strands in such a manner as to form a self-supporting structure having large openings between the strands and being highly open to water passing through the openings between the strands; and bisecting the structure along its axis to form two self-supporting half-shells.

2. The method of claim 1, wherein the tube is generally rectangular in cross-section.

3. The method of claim 1, wherein said producing step is carried out by extrusion.

4. The method of claim 1, wherein said bisecting step is carried out by cutting.

* * * * *